US009856048B1

(12) United States Patent
Russell et al.

(10) Patent No.: US 9,856,048 B1
(45) Date of Patent: Jan. 2, 2018

(54) ELECTRONIC DEVICE PACKAGE

(71) Applicant: Amazon Technologies, Inc., Seattle, WA (US)

(72) Inventors: Paul Grady Russell, Campbell, CA (US); Karl Anton Bakker, San Mateo, CA (US); Joselito Tansingco Crespo, Burlingame, CA (US); Patrick Dean Lewis, San Jose, CA (US); John Harvey Lucas, San Francisco, CA (US); Kristina Gayle de la Lama, Santa Cruz, CA (US); Paul Clayton Marchetti, Campbell, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/869,751

(22) Filed: Sep. 29, 2015

Related U.S. Application Data

(60) Provisional application No. 62/220,226, filed on Sep. 17, 2015.

(51) Int. Cl.
*B65D 5/00* (2006.01)
*B65D 5/02* (2006.01)
(Continued)

(52) U.S. Cl.
CPC ..... *B65D 5/029* (2013.01); *B65D 5/062* (2013.01); *B65D 5/2042* (2013.01);
(Continued)

(58) Field of Classification Search
CPC ..... B65D 5/029; B65D 5/062; B65D 5/2042; B65D 5/4204; B65D 5/4266; B65D 5/445;
(Continued)

(56) References Cited

U.S. PATENT DOCUMENTS 5,230,463 A * 7/1993 Brauner ..... B65D 5/6602 229/138
7,810,640 B2 * 10/2010 Weston ..... B65D 5/38 206/483
(Continued)

OTHER PUBLICATIONS

Brookside Dark Chocolate Goji & Raspbery Flavors, retrieved on Sep. 2, 2015 at <<http://www.brooksidechocolate.com/usa/chocolate-covered-snacks/fruit-flavored-centers/dark-chocolate-goji>>, 2 pages.
(Continued)

*Primary Examiner* — Christopher Demeree
(74) *Attorney, Agent, or Firm* — Lee & Hayes, PLLC

(57) ABSTRACT

A package for an electronic device includes an enclosure to hold the electronic device. The package may include a closure flap coupled to a top of the package to close the enclosure. The closure flap may include a tear strip usable to open the package. A sled may be disposed in the package and may include a substantially planar backplane and a sleeve. The electronic device may be held in a gap between the backplane and the sleeve. A portion of a top edge of the package, under the closure flap, may be recessed such that when the closure flap is opened, a pull tab of the sled is exposed. The package may include a hole formed through at least one surface of the package, from which to hang the package.

19 Claims, 12 Drawing Sheets

(51) Int. Cl.

| | |
|---|---|
| ***B65D 5/06*** | (2006.01) |
| ***B65D 5/20*** | (2006.01) |
| ***B65D 5/42*** | (2006.01) |
| ***B65D 5/44*** | (2006.01) |
| ***B65D 5/50*** | (2006.01) |
| ***B65D 5/54*** | (2006.01) |

(52) U.S. Cl.
CPC ..... *B65D 5/4204* (2013.01); *B65D 5/4266* (2013.01); *B65D 5/445* (2013.01); *B65D 5/5038* (2013.01); *B65D 5/5045* (2013.01); *B65D 5/541* (2013.01)

(58) Field of Classification Search
CPC .... B65D 5/5038; B65D 5/5045; B65D 5/541; B65D 33/04; B65D 5/068; B65D 5/2028; B65D 5/48024

USPC ..... 229/108, 236, 240, 243, 120.02, 120.08, 229/120.09, 122, 203, 125.125, 904; 206/558, 459.5, 562, 565, 589, 524.6, 206/538; 383/14, 106
See application file for complete search history.

(56) References Cited

U.S. PATENT DOCUMENTS

| | | | | |
|---|---|---|---|---|
| D678,049 | S | 3/2013 | Bakker et al. | |
| D707,123 | S | 6/2014 | Marchetti et al. | |
| 2003/0111521 | A1* | 6/2003 | Holmes | B65D 5/0254 229/117 |
| 2008/0296360 | A1* | 12/2008 | Abel | B65D 5/068 229/137 |
| 2013/0009606 | A1* | 1/2013 | Smith | A61B 19/0256 320/137 |
| 2015/0001109 | A1* | 1/2015 | Gibson | B31D 1/0075 206/264 |

OTHER PUBLICATIONS

Brookside Holiday Dark Chocolate Acai With Blueberry Flavors, Gift Bag, 5.5 Ounce (Pack of 12) retrieved on Sep. 2, 2015 at <<http://www.amazon.com/brookside-holiday-chocolate-blueberry-flavors/dp/b00if3zogo? tag=isthisnice-20>>.

Godiva Dark Chocolate Almonds, retrieved on Sep. 2, 2015 at <<http://www.godiva.com/dark-chocolate-almonds/76595.html>> 5 pages.

Godiva Wrapped Milk Chocolate Truffles, retrieved on Sep. 2, 2015 at <<http://www.godiva.com/wrapped-milk-chocolate-truffles/73244.html>> 5 pages.

Starbuck's via Ready Brew Italian Roast, extra bold instant coffee, retrieved on Sep. 2, 2015 at <<http://store.starbucks.com/starbucks-via-ready-brew-italian-roast-011008130.html?navid=xsellYMAL>>, 7 pages.

* cited by examiner

ELECTRONIC DEVICE PACKAGE

RELATED APPLICATION

This application claims the benefit of U.S. Provisional Application Ser. No. 62/220,226, filed Sep. 17, 2015, entitled "PACKAGE WITH PULL-TAB AND INTEGRATED SLEEVE," assigned to the assignee hereof and the entirety of which is incorporated herein by reference.

BACKGROUND

Existing packaging for electronic devices is bulky, heavy, expensive, and/or wasteful. Frequently, the packaging includes an exterior box, filled with polystyrene foam or other packing material to hold the electronic device firmly in the exterior box and protect it from impacts and compressive forces. Such existing packaging is difficult and time consuming to open, often requiring tools (e.g., scissors or a knife) to open.

Upon purchasing a new electronic device, consumers may become frustrated if they have to spend time locating tools and struggling to open the electronic device package before they can use their new electronic device.

BRIEF DESCRIPTION OF THE DRAWINGS

The detailed description references the accompanying figures. In the figures, the left-most digit(s) of a reference number identifies the figure in which the reference number first appears. The use of the same reference numbers in different figures indicates similar or identical items.

DETAILED DESCRIPTION

As discussed above, existing packaging for electronic devices is bulky, heavy, expensive, wasteful, and/or difficult to open.

This application describes a lightweight and low cost package for a tablet or other electronic device. The package comprises an enclosure to receive the electronic device. An exterior of the package may comprise a pouch, envelope, or other structure that defines the enclosure. The package may include a tear strip to easily open the package to remove the electronic device. A slot opening may be formed in the package for hanging the package on an in-store rack or display. The package may contain a sled which receives and holds the electronic device inside the package between a planar backplane and a sleeve. The sleeve may hold a charger, cord, adapter, instructions, or other accessories for the electronic device.

To open the package, the user pulls the tear strip, which opens the exterior of the package. A portion of a wall of the package may be scalloped or recessed relative to another portion of the wall of the package to provide visibility to an upper portion of the enclosure. After pulling the tear strip and opening the exterior of the package, a pull tab of the sled is exposed by the scallop in the wall of the package. The user then pulls the pull tab to remove the sled, including the electronic device and its accessories, from the package. In some examples, the package, including the sled, may be made of paperboard, such that the whole package may be recyclable. In other examples, portions of the package may be made of other materials, such as paper, plastic, corrugated cardboard, combinations of these, or the like. In some examples, the exterior of the package may have a window formed in one or more surfaces of the package so that at least a portion of the electronic device is visible from outside the package. The window may comprise a cutout (e.g., a hole in a wall of the package). In some examples, the window may be covered (inside or outside) with a transparent plastic. However, in other examples, the window may be open to allow consumers to touch the product in the enclosure without opening the package.

These and other examples are described further below with reference to the accompanying drawings.

Example Package

Figures 1A, 1B, 1C:
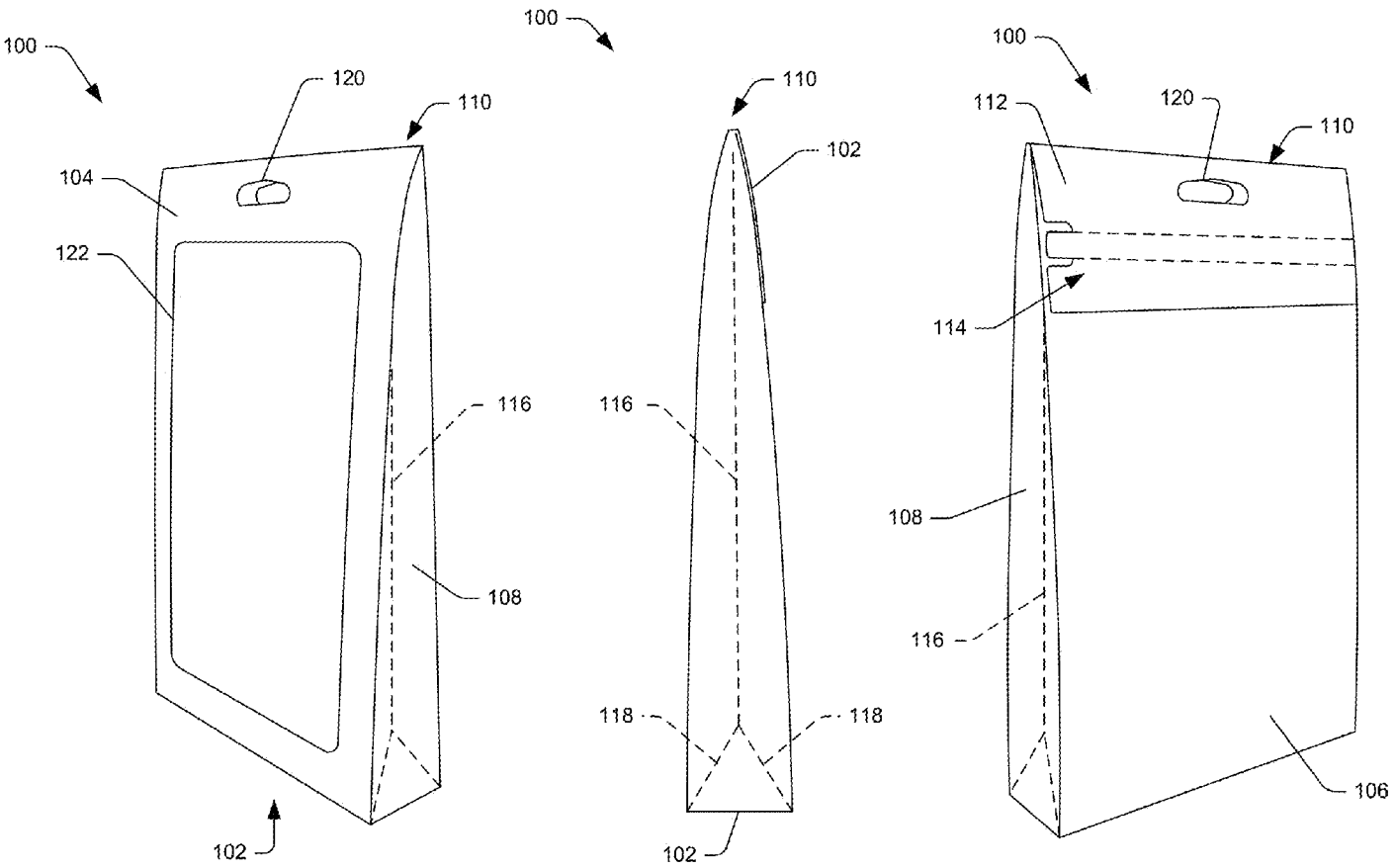
FIG. 1A is a front perspective view of an example package for holding an electronic device such as a tablet.
FIG. 1B is a side view of the example package of FIG. 1.
FIG. 1C is a back perspective view of the example package of FIG. 1.

FIGS. 1A-1C illustrate an example package 100 for a tablet or other electronic device. FIG. 1A is a perspective view of the package 100 taken from a front and right of the package 100. FIG. 1B is a right-side view of the package 100. FIG. 1C is another perspective view of the package 100 taken generally from the back and right of the package 100. The package 100 in this example comprises a pouch with a substantially planar bottom surface 102. In the illustrated example, the bottom surface 102 is substantially rectangular. However, in other examples, the substantially planar bottom surface may take other shapes (e.g., circular, oval, eye shaped, square, etc.). In some examples, the bottom of the package 100 may not be substantially planar. For example, the bottom of the package 100 may comprise a crease or fold (such as that shown in the example of FIG. 11) or may have a curved bottom surface (such as the package shown in FIGS. 10A-10C).

Referring back to FIGS. 1A-1C, the package 100 includes five walls, which collectively define an enclosure. Specifically, the five walls in the illustrated example comprise the substantially planar bottom surface 102, a substantially rectangular front wall 104, a substantially rectangular back wall 106, a first side wall 108, and a second sidewall (not visible in these figures). The substantially planar bottom surface 102 has a front edge opposite a back edge, and a first side edge opposite a second side edge. The substantially rectangular front wall 104 has a top edge opposite a bottom edge and a first side edge opposite a second side edge. In this example, the bottom edge of the front wall 104 is coupled to the front edge of the bottom surface 102. The substantially rectangular back wall 106 has a top edge opposite a bottom edge and a first side edge opposite a second side edge. In this example, the bottom edge of the substantially rectangular back wall 106 is coupled to the back edge of the bottom surface 102, and the top edge of substantially rectangular back wall 106 abuts the top edge of the substantially rectangular front wall 104 at an acute angle or peak 110. In some examples, near where they meet at the peak 110, the substantially rectangular front wall 104 and the substantially rectangular back wall 106 may abut and gently squeeze a top of the tablet or other electronic device, thereby holding the electronic device and limiting its movement within the package 110. This arrangement also provides some protection to the electronic device in the package.

The first side wall 108 is coupled to the first side edge of the substantially planar bottom surface 102, the first side edge of the substantially rectangular front wall 104, and the first side edge of the substantially rectangular back wall 106. The second side wall (not visible in these figures) is coupled to the second edge of the substantially planar bottom surface 102, the second side edge of the substantially rectangular front wall 104, and the second side edge of the substantially rectangular back wall 106.

A closure flap 112 is coupled to the top edge of the substantially rectangular front wall 104 and folded over the peak 110 and coupled to a surface of the substantially rectangular back wall 106 to close the enclosure. The closure flap 112 includes a tear strip 114 usable to open the package 100.

In the illustrated example, the first side wall 108 and second sidewall (not visible) are generally rectangular panels, each having a crease 116 running along their centers extending at least partially along its length. The crease 116 folds toward an interior of the package 100 to allow the package 100 to fold substantially flat (with the substantially planar front 104 wall lying flat against the substantially planar back wall 106) prior to the package 100 being filled. As shown, crow's feet 118 are disposed at a bottom end of crease 116 and extend to corners of the substantially planar bottom surface 102 to allow the first side wall 108 and second sidewall (not visible) to fold inward relative to the substantially planar bottom surface 102.

The package 100 may include one or more hangars that allow the package to be hung on a rack or in-store display. In the illustrated example, the substantially rectangular front wall 104 and the closure flap 112 each has a hole 120 from which to hang the package 100. The hole 120 in the substantially rectangular front wall and the hole 120 in the closure flap are aligned in a direction substantially parallel with the bottom surface (i.e., through a thickness of the package) to allow a hook to pass through the holes 120. While the holes in this example are shown as being elongated triangular or tent-shaped holes, in other examples, other shaped hanger holes may be used (e.g., circular holes, slots, rectangular holes, etc.). Further, other types of hangars may be included. For example, instead of a hole thorough the package, a hook-shaped notch may be formed in the package, an adhesive hangar may be adhered to the package, or the like.

The package 100 may also include one or more windows 122 disposed in one or more walls of the package 100. In the illustrated example, a window 122 is shown in the substantially rectangular front wall 104. However, one or more windows may additionally or alternatively be disposed in the substantially rectangular back wall 106, the first side wall 108, or the second side wall. In some examples, at least a portion of the electronic device contained in the package may be visible from outside the package. The window 122 may be open to allow a consumer to touch or otherwise access a portion of the electronic device, or may be covered by a transparent plastic material. The size, shape, and location of the window(s) may vary depending on the nature of the product contained in the package. In other examples, instead of a window, the package 100 may include pictures, text, artwork, or other graphics describing or depicting the product contained in the package. Such graphics may be provided in addition to or instead of the window 122.

Figure 2:
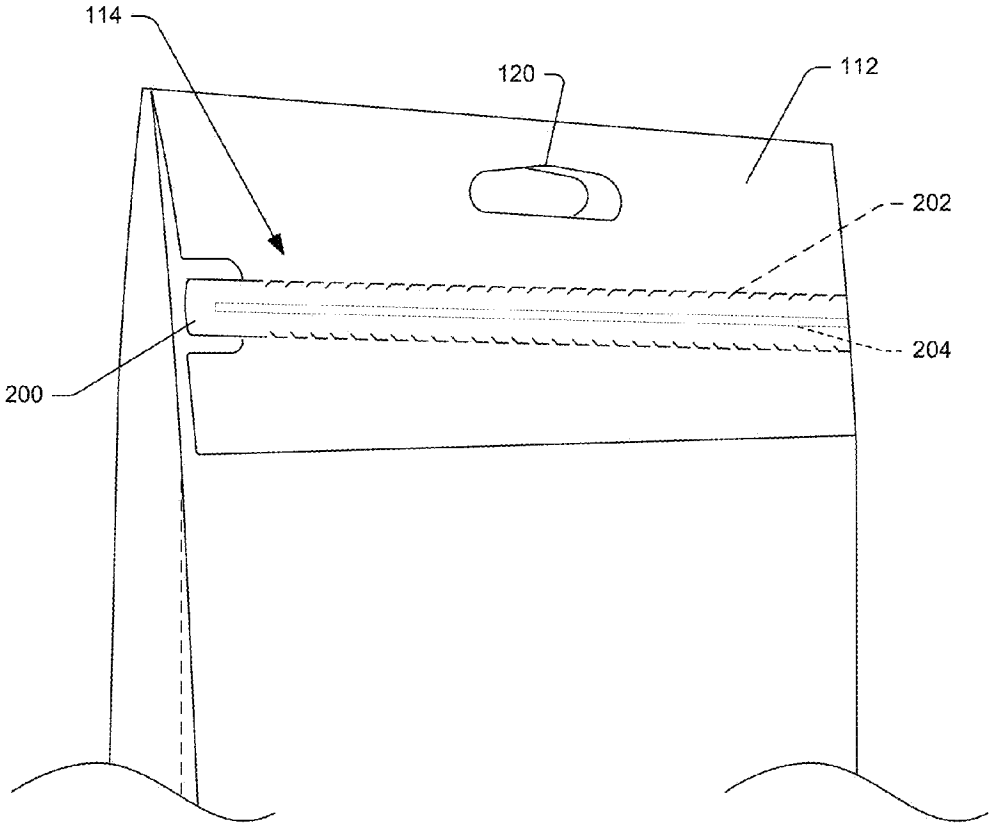
FIG. 2 is an enlarged detail view of the back perspective view of FIG. 1C, showing a tear strip for opening the package and a hang loop.

FIG. 2 is an enlarged detail view of the closure flap 112 of the package 100, showing additional details of the tear strip 114. As shown in FIG. 2, the tear strip 114 includes a tab 200, which a user may grip to pull open the tear strip 114. In this example, the tab 200 is shown as a substantially rectangular tab having rounded corners. However, in other examples, the size and shape of the tab may be different. For instance, in other examples, the tab 200 may have comprise a semi-circle, a semi-oval, a T-shape, an L-shape, or the like. The tear strip 114 in this example comprises a plurality of angled slits or perforations 202 extending in two parallel lines, horizontally along a width of the closure flap 112. In the illustrated example, the tear strip 114 spans substantially the width of the closure flap 112. However, in other examples, the tear strip 114 may span less than the entire width of the closure flap 112, or may extend in a different direction across at least a portion of the closure flap 112. For instance, while the tear strip is shown as being openable from left-to-right, in other examples the tear strip may be openable from right-to-left, up-to-down, down-to-up, diagonally, or any other direction. In still other examples, the tear strip 114 may be provided in or on a different surface of the package 110 (e.g., the substantially rectangular front wall 104, the substantially rectangular back wall 104, a side wall, or other surface). Also, while the tear strip 114 in this example comprises angled slits or perforations 202, in other examples, the tear strip may additionally or alternatively include weakened areas, score lines, and/or frangible areas that are designed to provide easy opening of the tear strip, while maintaining a structural integrity of the package (e.g., minimizing or preventing inadvertent opening). In the illustrated example, the tear strip 114 also comprises a reinforced strip 204, which is shown in dashed lines to indicate that it is disposed on an inner surface of the closure flap 112. In some examples, the reinforced strip 204 may comprise plastic (e.g., polyethylene), string, fiber floss, filament, or other material to strengthen the tear strip and prevent it from breaking and/or to help facilitate cutting of the package material.

Figure 3:
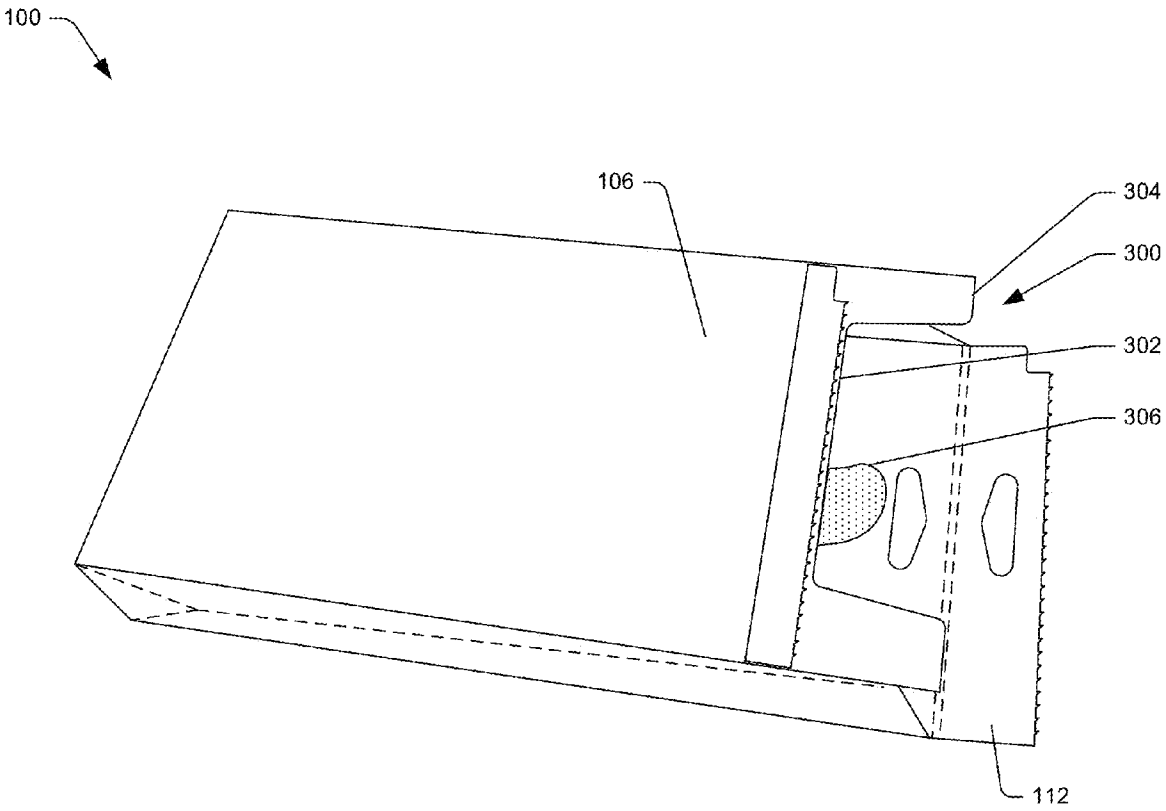
FIG. 3 is a perspective view of the package of FIG. 1A in a partially open condition with the tear strip torn off to expose a pull tab of a sled for removing contents of the package.

FIG. 3 illustrates the example package 100 of FIGS. 1A-1C in an open condition. As shown in FIG. 3, the tear strip 114 has been pulled to tear open the package 100, and the closure flap 112 has been folded open to reveal an opening to the enclosure of the package 100. As shown in FIG. 3, a top edge 300 of the substantially rectangular back wall 106 includes a scalloped or recessed portion 302 and a non-recessed portion 304. That is, the recessed portion 302 is recessed relative to the non-recessed portion 304 of the top edge of the substantially rectangular back wall 106. In this example, the recessed portion 302 comprises a generally U-shaped recess. However, in other examples, the shape of the recessed portion 302 may have a different shape, such as a semi-circular shape, a semi-oval shape, a rectangular shape, or the like. When the closure flap 112 is opened, as shown in FIG. 3, the recessed portion 302 exposes a pull tab 306 that is usable to easily remove the contents of the package 100. The combination of the recessed portion 302 and the pull tab 306 provides a visual indication to the user of how to unpackage the electronic device.

Figure 4:
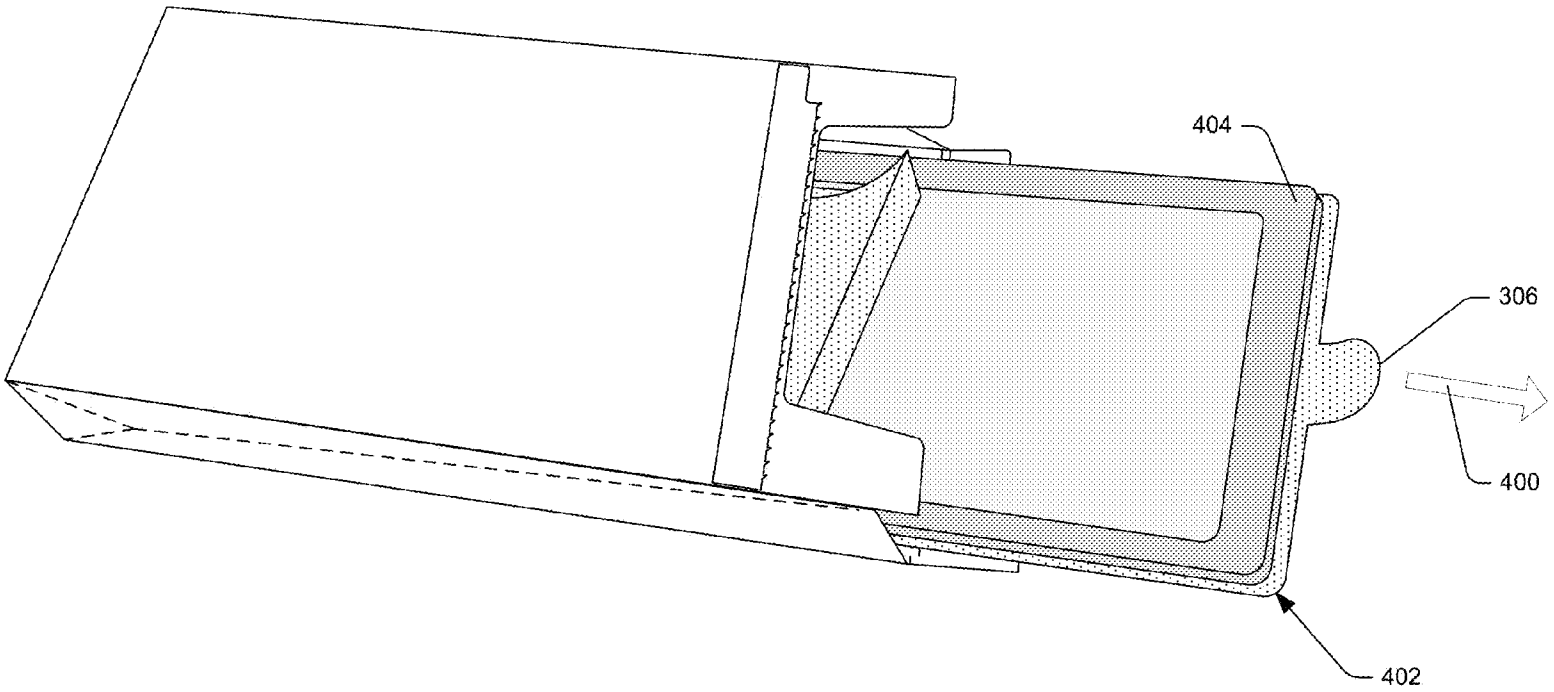
FIG. 4 is a perspective view of the package of FIG. 1A in an open condition with the sled partially removed from the package. The electronic device is pinched between a backplane and a sleeve of the sled to hold the bottom of the electronic device when the sled is in the package.

FIG. 4 illustrates the example package 100 in the open condition like FIG. 3, but after the pull tab 306 has been pulled in the direction of the arrow 400. As shown in FIG. 4, the pull tab 306 is part of a sled 402, which holds the electronic device 404 and any accessories within the package. Thus, the user can easily remove the sled 402, the electronic device 404, and any device accessories in one simple motion by simply pulling on the pull tab 306.

Figure 5:
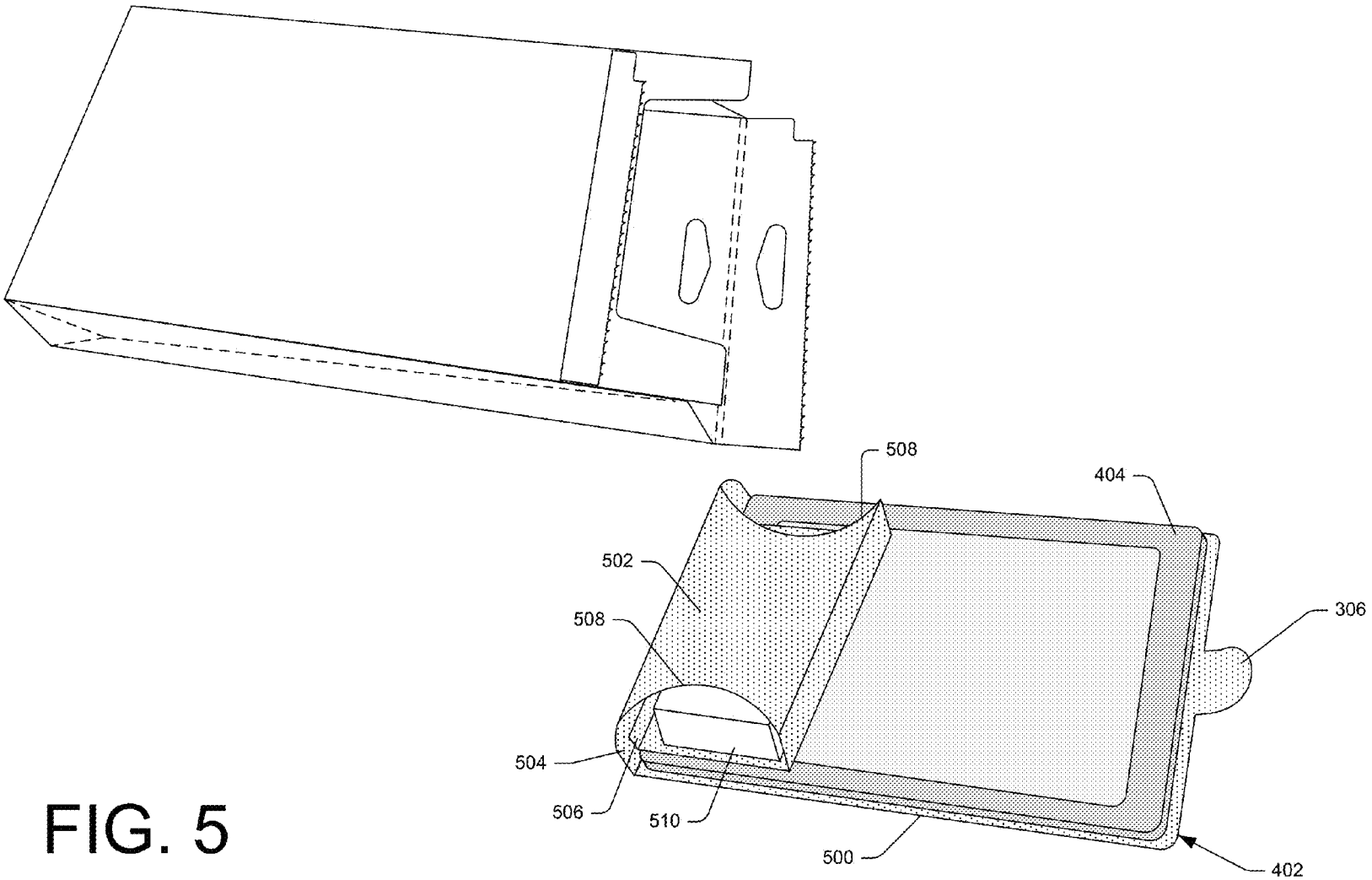
FIG. 5 is a view showing the sled fully removed from the package to expose contents of the package.

FIG. 5 shows the example package 100 with the sled 402 completely removed from the package 100. As shown in FIG. 5, the sled comprises a substantially planar backplane 500 and a sleeve 502 coupled to a bottom of the substantially planar backplane 500 by spine 504. The spine 504 couples the sleeve 502 to the substantially planar backplane 500 along at least a portion of an edge of the substantially planar backplane 500. The sleeve 502 is coupled to the substantially planar backplane 500 with a gap therebetween. The electronic device 404 is disposed within the package 100 and held in the gap between the substantially planar backplane 500 and the sleeve 502. In some examples, the package 100 may be sized such that the substantially rectangular front wall 104 and the substantially rectangular back wall 106 press the sleeve 502 toward the substantially planar backplane 500 when the sled 402 is in the enclosure, thereby gently squeezing or compressing the electronic device 404 between the substantially planar backplane 500 when the sled 402 to hold the electronic device 404 in place in the package 100.

The sleeve 502 in this example is made of a same piece of paperboard material as the substantially planar backplane 500, and is formed by folding a portion of the paperboard opposite the pull tab 306 if folded completely around onto itself. That is, the portion of the paperboard opposite the pull tab 306 is folded five times to form five substantially right angles, such that an anchor strip 506 is substantially parallel to the spine 504. The anchor strip is glued or otherwise secured to the spine to form the sleeve 502. The sleeve 502 in this example includes to semi-circular cutouts 508 in a saddle portion of the sleeve 502 to provide easy access for a user to grasp and remove items disposed within the sleeve 502. In some examples, the sleeve 502 may hold a charger, cord, adapter, instructions, or other accessories 510 of the electronic device 404.

Example Package Forming Methods

Figure 6:
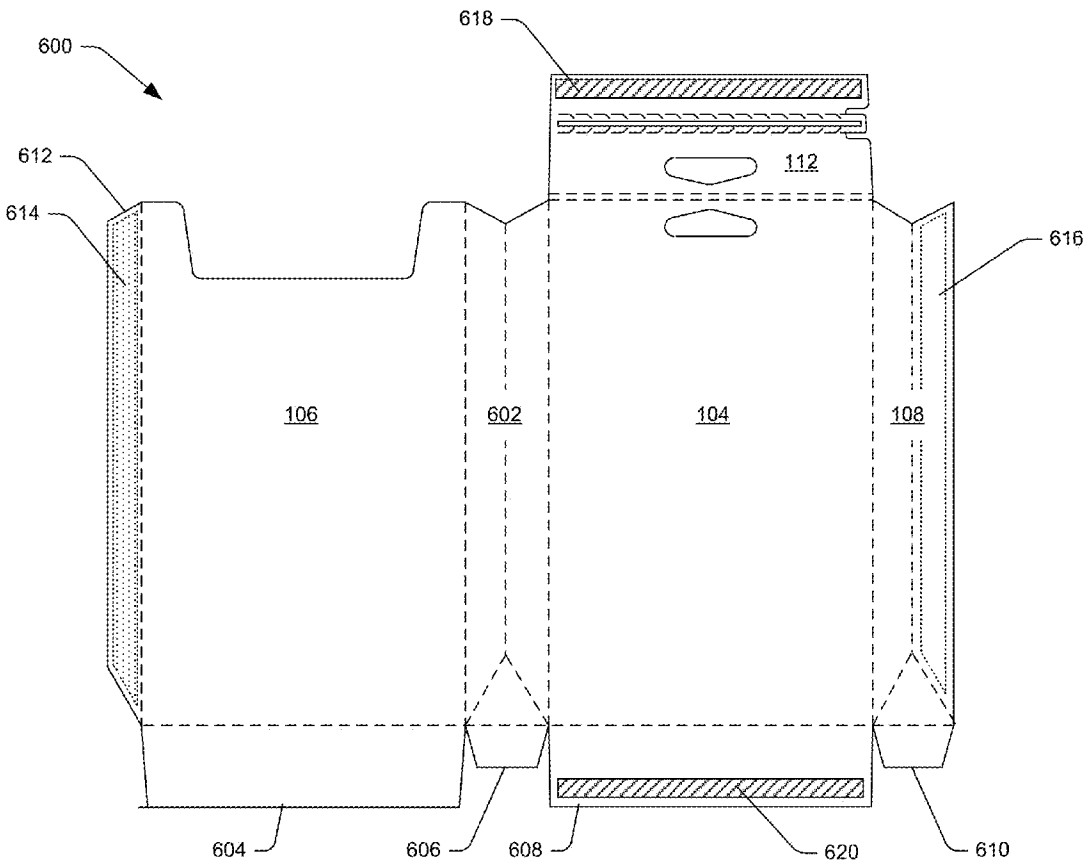
FIG. 6 is an example package blank usable to make the package of FIG. 1A.

FIG. 6 illustrates an example package blank 600 usable to make the example package 100. FIG. 6 illustrates a side of the package blank 600 that, once folded, will become the inside of the package 100. The package blank 600 in this example includes the substantially rectangular front wall 104, the substantially rectangular back wall 106, the first side wall 108, and the second side wall 602. Four bottom flaps 604, 606, 608, and 610 collectively fold to form the substantially planar bottom surface 102 of FIGS. 1A-1C. The package blank 600 includes a number of score lines (shown in dashed lines) corresponding to locations where the package blank 600 will be folded to form the package 100.

The package blank 600 also includes an overlapping surface 612 having an adhesive 614 (e.g., glue, pressure sensitive adhesive, etc.). The adhesive 614 is shown in dashed lines to indicate that it is applied to the outside of the package blank (i.e., the side opposite the side shown face up in FIG. 6). When the package is folded, the overlapping surface 612 aligns and overlaps with a portion of the first side wall 108 generally in the area 616 designated by dashed lines on the first side wall 108.

A strip of adhesive 618 (e.g., glue or pressure sensitive adhesive) is applied to the inside surface of the closure flap 112. The strip of adhesive 618 is used to hold the closure flap 112 closed. A second strip of adhesive 620 (e.g., glue or pressure sensitive adhesive) is disposed on the bottom flap 608 that extends from the substantially rectangular front wall 104, and is used to seal a bottom of the package once the electronic device has been inserted.

Figure 7:
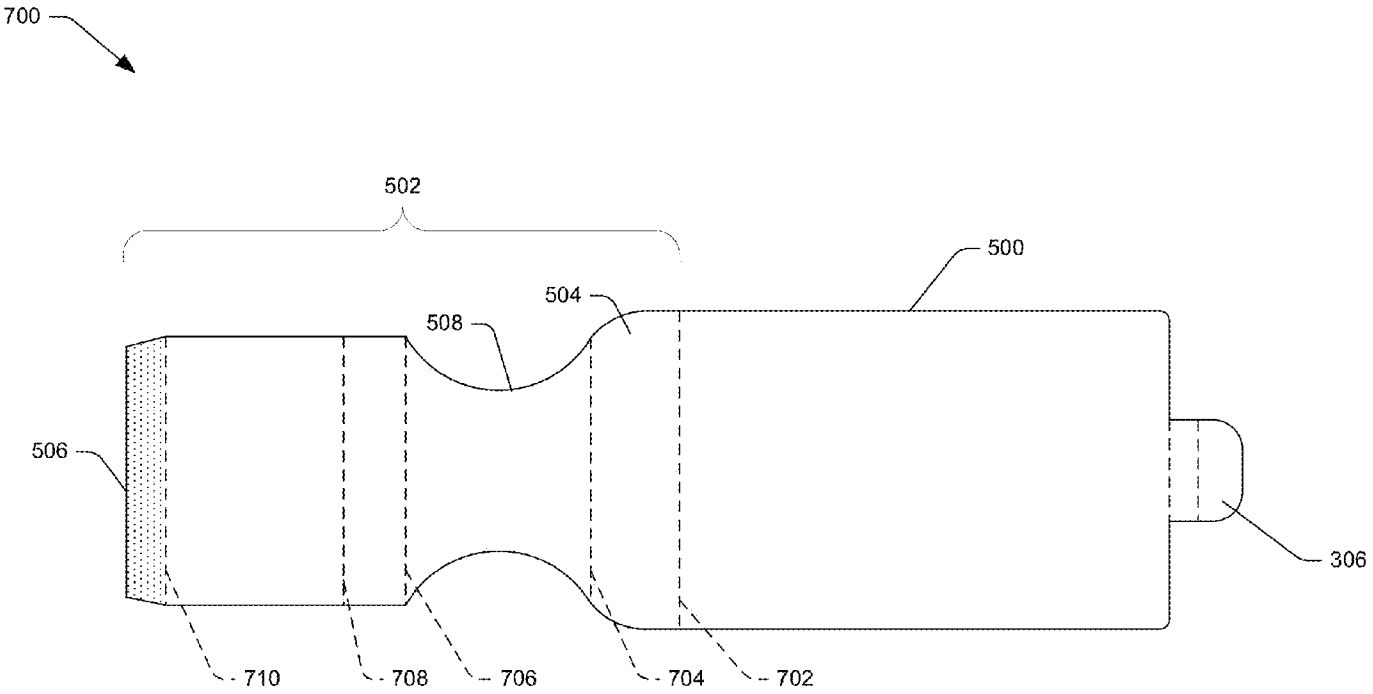
FIG. 7 is an example sled blank usable to make the sled of FIG. 5.

FIG. 7 illustrates an example sled blank 700 usable to make the example sled 402. The sled blank 700 includes the pull tab 306, the substantially planar backplane 500. The sleeve 502 is also represented on the sled blank 700 in a flattened condition. The sleeve blank 700 includes five score lines 702, 704, 706, 708, 710, at which the sleeve blank 700 will be folded to form the sleeve 502. Specifically, the hinge 504 is disposed between the first score line 702 and the second score line 704. The semi-circular cutouts 508 in a saddle portion of the sleeve 502 are disposed between the second score line 704 and the third score line 706. A surface of the sleeve 502 that when formed is closest to the pull tab 306 is disposed between the third score line 706 and the fourth score line 708. A surface of the sleeve that when folded is closest to the substantially planar backplane 500 is disposed between the fourth score line 708 and the fifth score line 710. The anchor strip 506 is disposed distal to the fifth score line and has an adhesive (e.g., glue or pressure sensitive adhesive) disposed on a back surface thereof (i.e., the surface opposite that shown in FIG. 7) in order to adhere or anchor to the spine 504.

Figure 8:
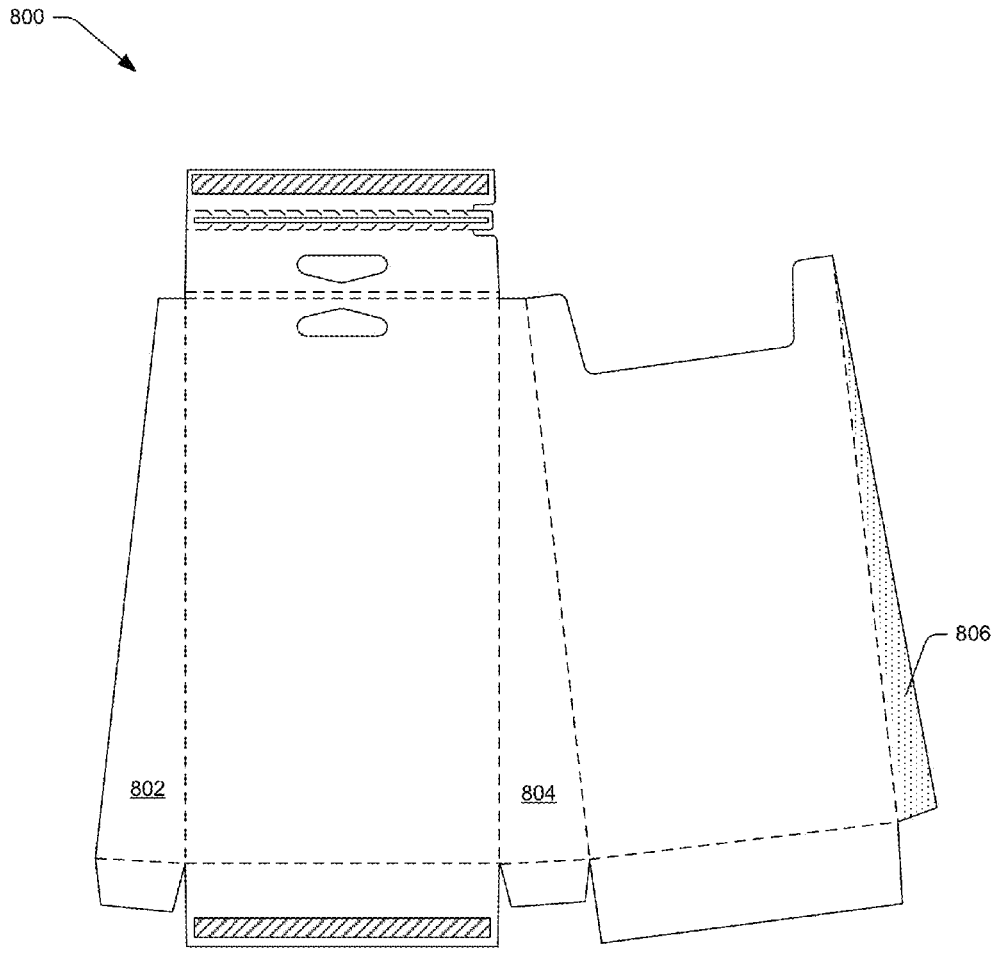
FIG. 8 is an example package blank having a triangular side wall, usable to make another package for an electronic device.

FIG. 8 illustrates an example package blank 800 to make another example package for an electronic device. Except as described below, the package blank 800 is similar to the package blank 600. Thus, a detailed description of the details of the package blank 800 that are in common with package blank 600 is omitted for brevity. The package blank 800 of this example has trapezoidal side walls 802 and 804, and a triangular overlapping surface 806 having an adhesive (e.g., glue, pressure sensitive adhesive, etc.) on a back side thereof (i.e., a side opposite the side shown in FIG. 8). The package blank 800 is usable to make package that is similar to the package 100, except that the side walls are not creased and do not fold inwardly. Instead, the package made by the package blank 800 has substantially planar, trapezoidal side walls.

Figure 9A:
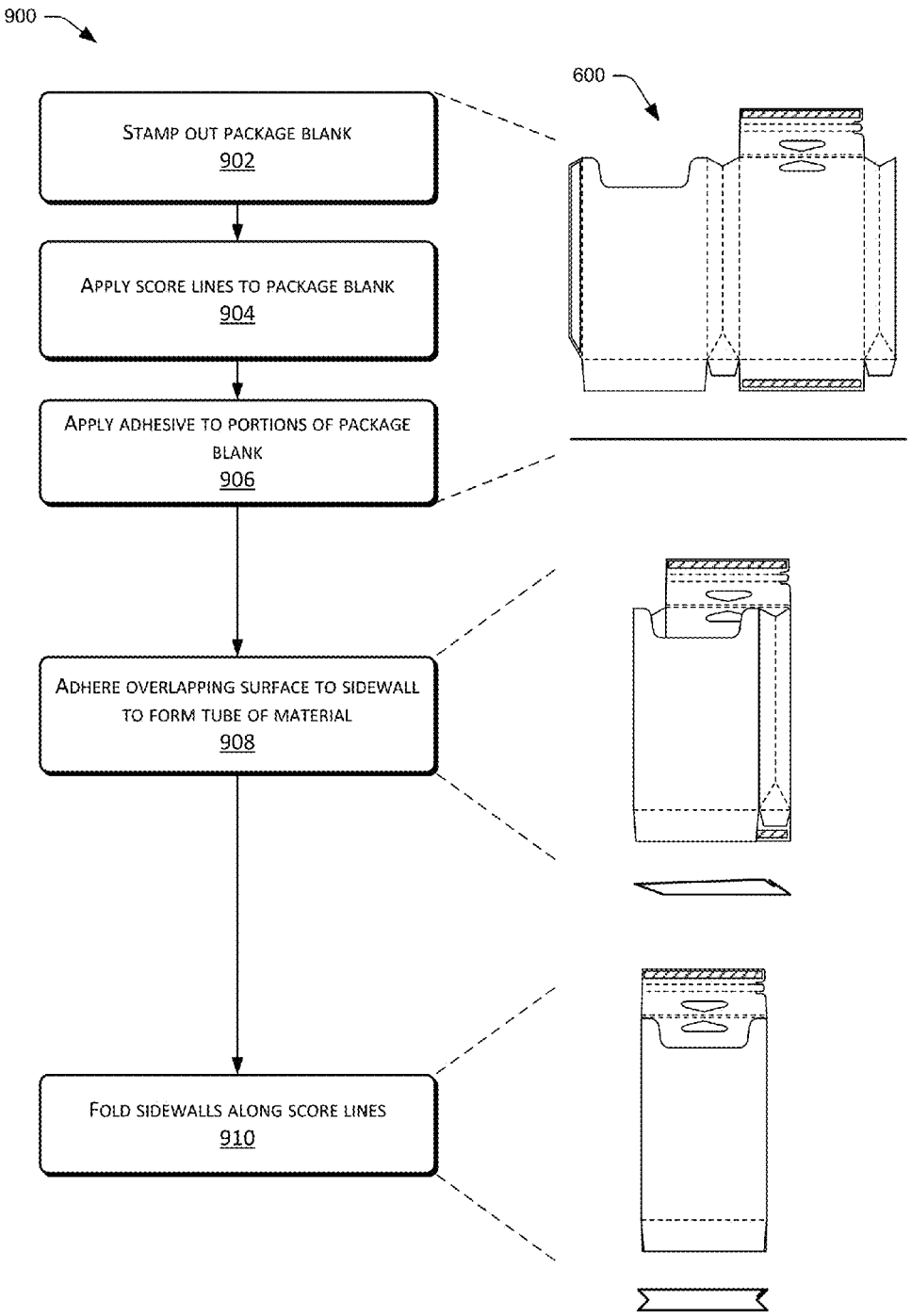
FIG. 9A is flowchart showing an example process of converting the packaging blank of FIG. 6 into the package of FIG. 1A.
Figure 9B:
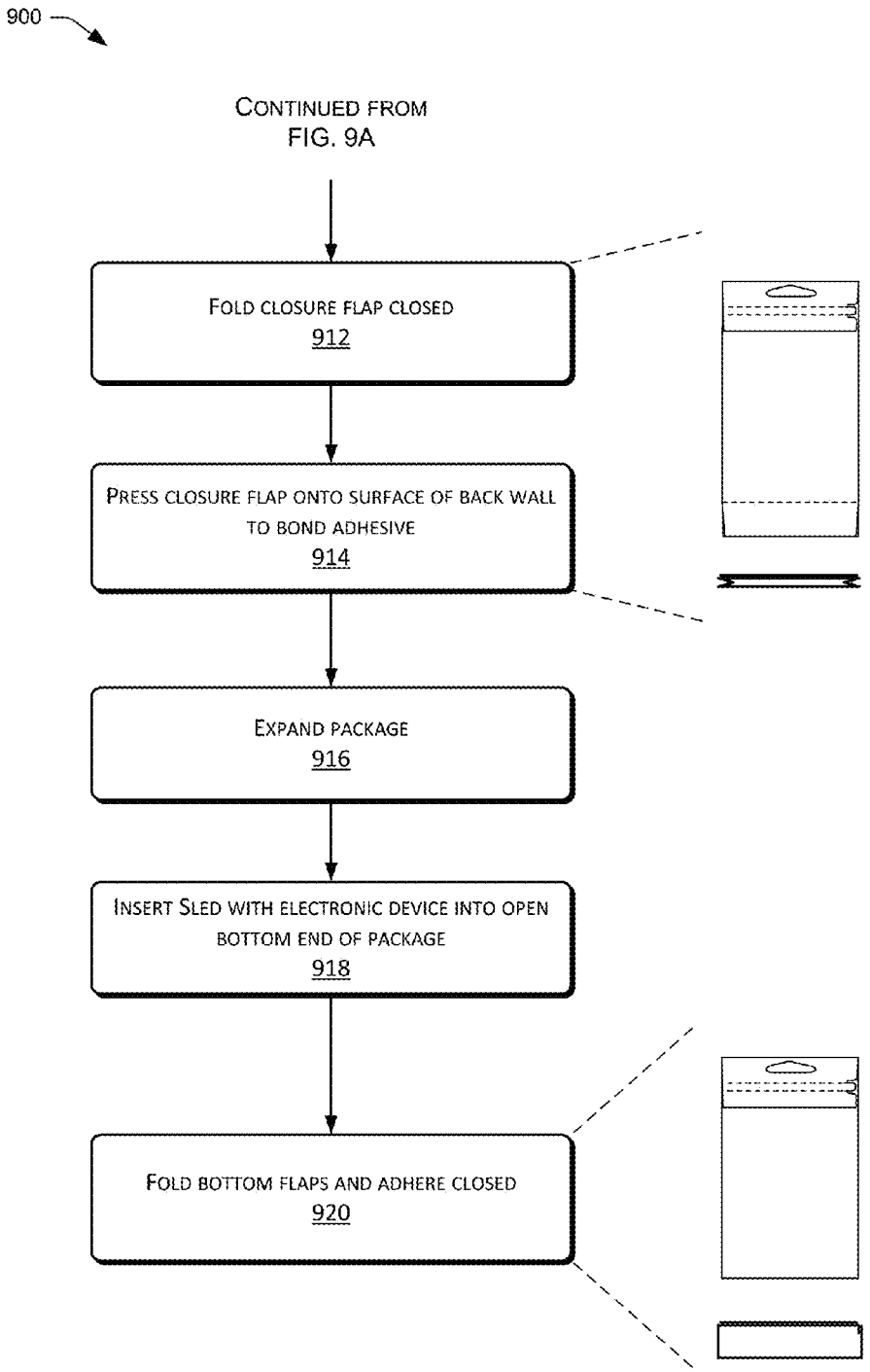
FIG. 9B is flowchart showing a continuation of the example process of converting the packaging blank of FIG. 6 into the package of FIG. 1A.

FIGS. 9A and 9B illustrate a flowchart showing an example method 900 to convert the package blank 600 into the example package 100. The method 900 includes, at block 902 stamping or otherwise cutting the package blank 600 from a sheet of paperboard or other stock material. At block 904, score lines are applied to the package blank 600 at each location that the package blank is to bend to form the package 100 (e.g., at the creases 116, the crow's feet 118, the peak 110, etc.). In some examples, the package blank 600 may be stamped (block 902) and scored (block 904) as part of a single manufacturing process or operation.

At block 906, the adhesives 614, 618, and 620 are applied to the respective locations shown in FIG. 6. The adhesives used at the various locations may be the same or some locations may be different than others. For instance, in some examples, the adhesive 614 used to adhere the overlapping portion 612 to the area 616 may comprise glue which may be sprayed or rolled on, while the adhesive 618 and 620 used on the closure flap 112 and the bottom flap 608, respectively, is a contact adhesive, such as a pressure sensitive adhesive tape. A top view of the package blank 600 as it appears during stages 902, 904, and 906 is shown alongside the corresponding flowchart blocks. A simplified cross sectional view of the package blank 600 is also shown directly below the top view. As shown, at this time, the package blank 600 comprises a substantially planar sheet.

At block 908, the package blank 600 is folded substantially in half and the overlapping surface 612 is adhered to the area 616 of the first side wall 108. Top and cross sectional views of packaging blank 600 as it appears during stage 908 are shown alongside the corresponding flowchart block. As shown, the packaging blank now has a substantially parallelogram cross sectional shape.

At block 910, the side walls 108 and 602 package blank 600 are folded along the score lines to create creases 116. The top and cross sectional views of packaging blank 600 as it appears during stage 910 are shown alongside the corresponding flowchart block. At this stage, the cross sectional view of the packaging blank 600 resembles a fold of an accordion.

Continuing on to FIG. 9B, at block 912, the closure flap 112 is folded over the peak 110 and onto a top portion of the substantially rectangular back wall 106. At block 914, the closure flap is pressed onto the substantially rectangular back wall 106 to bond the adhesive strip 618 to the substantially rectangular back wall 106 to close the top of the package 100. The top and cross sectional views of packaging blank 600 as it appears during stages 912 and 914 are shown alongside the corresponding flowchart blocks. At these stages, the cross sectional view of the packaging blank 600 resembles that during operation 910, except that it is more compressed such that the substantially rectangular front wall 104 approaches the substantially rectangular back wall 106. For clarity, the cross sectional view in these stages is not shown as flat as it actually is in practice.

At block 916, a bottom of the package blank 600 is expanded to allow for filling and, at block 918, the sled 402, holding the electronic device 404 and accessories 510, is inserted into an opening in the bottom end of the package blank 600. At block 920, the bottom flaps 604, 606, 610, and 608 are folded in to close the package, and the adhesive strip 620 adheres bottom flap 608 to a bottom surface of bottom flap 604 to seal a bottom of the package blank, thereby forming package 100. As shown in the top and cross sectional views alongside block 920, the cross section at this stage is substantially rectangular.

Other Example Packages

Figure 10C:
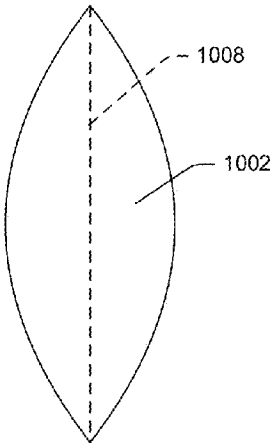
FIG. 10C is a bottom view of the example two-sided package of FIG. 10A.
Figure 10B:
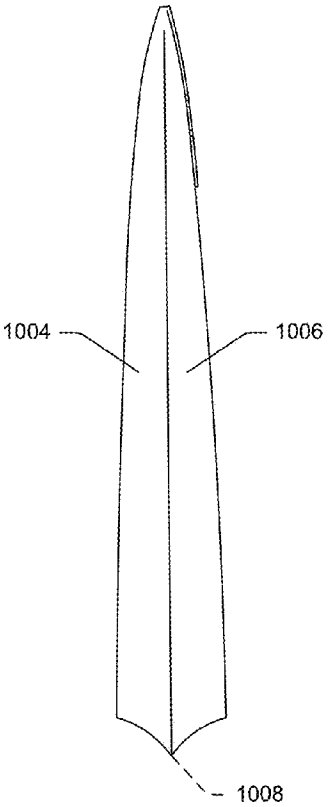
FIG. 10B is a side view of the example two-sided package of FIG. 10A.
Figure 10A:
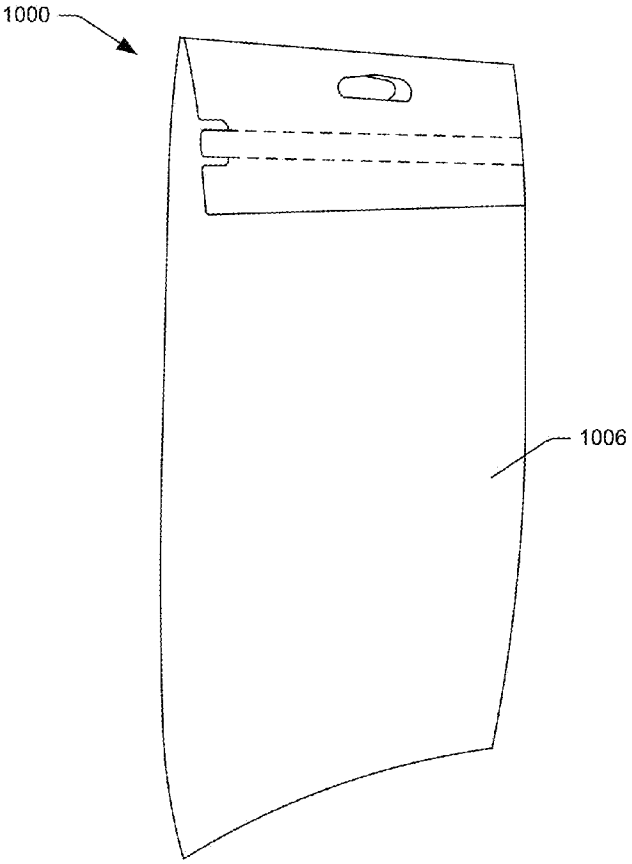
FIG. 10A is a perspective view of an example two-sided package to hold an electronic device.

FIGS. 10A-10C illustrate another example package 1000 having an enclosure for an electronic device. The package 1000 in this example is similar to that shown in FIGS. 1A-1C, except that a bottom surface 1002 of the package 1000 capping a bottom of the enclosure is eye-shaped, and side walls are omitted from the package. Thus, the package in this example is a two-sided package. Specifically, the package 1000 includes a curved front wall 1004 coupled along its side edges to a curved back wall 1006, such that the curved front wall 1004 and the curved back wall 1006 define a continuous perimeter around the package 1000. The bottom surface 1002 in this example has a crease 1008, which allows the bottom surface 1002 to fold to take the form shown in FIGS. 10A-10C. The package 1000 of this example may have a sled similar to that shown in FIG. 5. Alternatively, a sled sized and shaped to confirm with the eye-shape of the bottom surface 1002 may be used with the package 1000.

Figure 11:
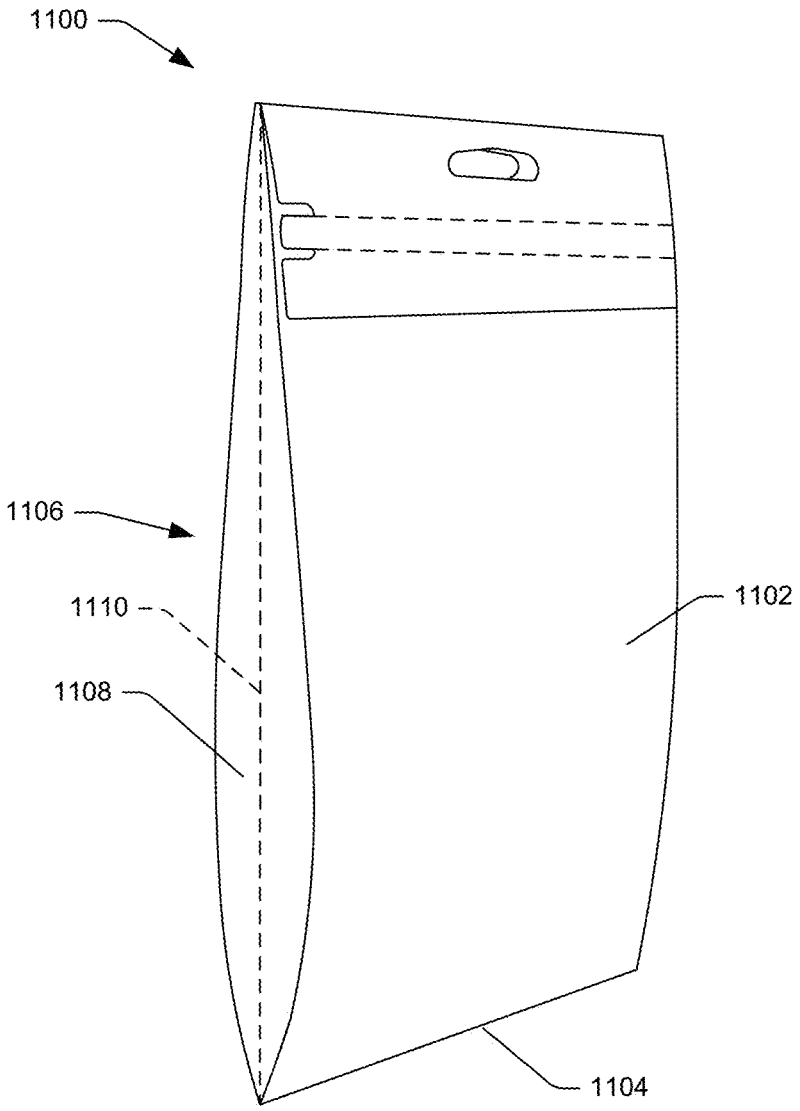
FIG. 11 is a perspective view of another example package to hold an electronic device.

FIG. 11 illustrates yet another example package 1100 having an enclosure for an electronic device. The package 1100 in this example is similar to that shown in FIGS. 1A-1C, except that it lacks a bottom surface. Thus, the package in this example has a curved front wall 1102 coupled along its bottom edge 1104 to a curved back wall 1106. A first side wall 1108 couples to a first edge of the curved front wall 1102 and a first edge of the curved back wall 1106. A second side wall (not visible in this figure) couples to a second edge of the curved front wall 1102 and a second edge of the curved back wall 1106. The first side wall 1108 and the second side wall each include a crease 1110 to allow the curved front wall 1102 and the curved back wall 1106 to expand apart from one another to accommodate the electronic device. In some examples, each of the first side wall 1108 and the second side wall may include multiple pleats to allow the curved front wall 1102 and the curved back wall 1106 to expand even further apart from one another to accommodate larger electronic devices. The package 1100 of this example may enclose a sled similar to that shown in FIG. 5. Alternatively, a thinner sled may be used with the package 1100. In still other examples, a sled may be omitted from the package 1100 and the electronic device may be placed directly in the enclosure of the package 1100 with or without other packaging materials.

CONCLUSION

While various examples and embodiments are described individually herein, the examples and embodiments may be combined, rearranged and modified to arrive at other variations within the scope of this disclosure.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A package for an electronic device, the package comprising:

an enclosure defined by:

a substantially rectangular bottom surface having a front edge that is opposite a back edge, and a first side edge that is opposite a second side edge;

a substantially rectangular front wall having a top edge that is opposite a bottom edge and a first side edge that is opposite a second side edge, the bottom edge of the front wall being coupled to the front edge of the bottom surface;

a substantially rectangular back wall having a top edge that is opposite a bottom edge and a first side edge that is opposite a second side edge, the bottom edge of the back wall being coupled to the back edge of the bottom surface, and the top edge of the back wall abutting the top edge of the front wall;

a first side wall coupled to the first side edge of the bottom surface, the first side edge of the front wall, and the first side edge of the back wall;

a second side wall coupled to the second edge of the bottom surface, the second side edge of the front wall, and the second side edge of the back wall;

a closure flap coupled to the top edge of the front wall and folded over and coupled to a surface of the back wall to close the enclosure, the closure flap comprising a tear strip usable to open the package; and a sled disposed in the enclosure, the sled comprising a substantially planar backplane and an open ended, tubular sleeve coupled to a bottom of and spaced apart by a distance from the substantially planar backplane.

2. The package of claim 1, wherein:

the first side wall comprises a crease extending at least partially along a length of the first side wall, wherein the crease folds toward an interior of the package; and the second side wall comprises a crease extending at least partially along a length of the second side wall, wherein the crease folds toward an interior of the package.

3. The package of claim 1, wherein:

the sled comprises a pull tab; and the top edge of the substantially rectangular back wall comprises a generally U-shaped recess that, when the closure flap is opened, exposes the pull tab of the substantially planar backplane of the sled.

4. The package of claim 1, wherein the electronic device is disposed within the package and held between the substantially planar backplane and the sleeve.

5. The package of claim 1, wherein the substantially rectangular bottom surface, the substantially rectangular front wall, the substantially rectangular back, the first side wall, the second side wall, and the closure flap are comprised of paperboard.

6. The package of claim 1, wherein the tear strip comprises a plurality of perforations or score lines that span at least a portion of the closure flap.

7. The package of claim 1, wherein the tear strip comprises a reinforced strip disposed on an inner surface of the closure flap.

8. The package of claim 1, the substantially rectangular front wall and the closure flap each comprising a hole from which to hang the package, the hole disposed in the substantially rectangular front wall and the hole disposed in the closure flap being aligned in a direction substantially parallel with the bottom surface.

9. The package of claim 1, wherein at least one of the substantially rectangular front wall, the substantially rectangular back wall, the first side wall, or the second side wall comprises a window through which at least a portion an electronic device is visible from outside the package when the electronic device is placed inside the package.

10. A packaged electronic device, comprising:

a pouch shaped package defining an enclosure;

a sled enclosed within the enclosure, the sled comprising:

a substantially planar backplane;

an open ended, tubular sleeve spaced apart from the substantially planar backplane; and a spine coupling the sleeve to the substantially planar backplane along at least a portion of an edge of the substantially planar backplane; and an electronic device disposed within the enclosure of the package and in a space between the substantially planar backplane and the sleeve.

11. The packaged electronic device of claim 10, further comprising a tear strip disposed on a closure flap of the package, the tear strip comprising a tab usable to open the package.

12. The packaged electronic device of claim 11, wherein the tear strip further comprises:

a plurality of perforations or score lines that spans at least a portion of the closure flap; and a reinforced strip disposed on an inner surface of the closure flap.

13. The packaged electronic device of claim 10, wherein:

the sled comprises a pull tab; and the pouch shaped package comprises multiple walls defining the enclosure, and a top edge of at least one of the multiple walls comprises a generally U-shaped recess that, when the package is opened, exposes the pull tab of the sled.

14. The packaged electronic device of claim 10, wherein the package is comprised of paperboard and has a hole extending through at least one surface of the package from which to hang the package.

15. A package comprising:

a substantially rectangular front wall and a substantially rectangular back wall at least partially defining an enclosure of the package;

a closure flap coupled to a top edge of the front wall and folded over and coupled to a surface of the back wall to close a top of the enclosure; and a sled disposed in the enclosure to hold a product in the enclosure, the sled comprising a pull tab usable to remove the product from the package, wherein a top edge of the substantially planar back wall includes a generally U-shaped recessed portion that is interposed between two non-recessed portions, and the recessed portion is recessed relative to the two non-recessed portions of the top edge of the substantially planar back wall such that when the closure flap is opened, the recessed portion exposes the pull tab of the sled.

16. The package of claim 15, further comprising a tear strip disposed on the closure flap of the package, the tear strip comprising a tab usable to open the package.

17. The package of claim 15, wherein the sled comprises a substantially planar backplane and a sleeve coupled to a bottom of and spaced apart from the substantially planar backplane by a distance sized to receive the product.

18. The package of claim 15, further comprising a substantially planar bottom surface capping a bottom of the enclosure.

19. The package of claim 15, wherein the package is comprised of paperboard and has a hole extending through at least one surface of the package from which to hang the package.

* * * * *